US008878886B2

(12) United States Patent
Nito

(10) Patent No.: US 8,878,886 B2
(45) Date of Patent: Nov. 4, 2014

(54) LIGHT BEAM SCANNING DEVICE AND IMAGE FORMING APPARATUS THAT PERFORM LIGHT AMOUNT CONTROL

(75) Inventor: Yuta Nito, Toride (JP)

(73) Assignee: Canon Kabushiki Kaisha (JP)

( * ) Notice: Subject to any disclaimer, the term of this patent is extended or adjusted under 35 U.S.C. 154(b) by 290 days.

(21) Appl. No.: 13/352,501

(22) Filed: Jan. 18, 2012

(65) Prior Publication Data

US 2012/0188323 A1 Jul. 26, 2012

(30) Foreign Application Priority Data

Jan. 21, 2011 (JP) ..... 2011-010752

(51) Int. Cl.
*B41J 2/435* (2006.01)
*B41J 2/47* (2006.01)

(52) U.S. Cl.
CPC ..... *B41J 2/473* (2013.01)
USPC ..... 347/236

(58) Field of Classification Search
None
See application file for complete search history.

(56) References Cited

U.S. PATENT DOCUMENTS 4,933,549 A * 6/1990 Fujioka et al. ..... 250/235
7,738,005 B2 6/2010 Takahashi
7,936,367 B2 5/2011 Ishida et al.
8,305,416 B2 11/2012 Maeda
2005/0036027 A1* 2/2005 Tanimoto et al. ..... 347/236
2007/0236557 A1* 10/2007 Imai et al. ..... 347/259

FOREIGN PATENT DOCUMENTS

JP 09-230259 A 9/1997
JP 09230259 A * 9/1997 ..... G02B 26/10
JP 2006-315278 A 11/2006
JP 2009-090524 A 4/2009
JP 2009-157014 A 7/2009
JP 2010-214892 A 9/2010
JP 2010-281869 A 12/2010

OTHER PUBLICATIONS

Office Action, dated Aug. 19, 2014, issued in corresponding Japanese Patent application No. 2011-010752.

* cited by examiner

*Primary Examiner* — Geoffrey Mruk
*Assistant Examiner* — Bradley Thies
(74) *Attorney, Agent, or Firm* — Rossi, Kimms & McDowell LLP

(57) ABSTRACT

A light beam scanning device capable of suppressing lowering of accuracy of light amount control when scanning a photosensitive member using light beams. A semiconductor laser has light emitting elements for emitting respective light beams. A polygon mirror deflects the light beams such that each light beam scans a photosensitive member in a predetermined direction. A photodiode sensor is disposed where the light beams enter. A CPU controls the light amount of each light beam based on an output from the sensor. The first and second light emitting elements are arranged such that respective light beams therefrom are adjacent to each other in the direction and there is time during which both the light beams enter the sensor. The CPU executes the control for the first and second light emitting element, at receptive different cycles of scanning of the light beams.

4 Claims, 8 Drawing Sheets

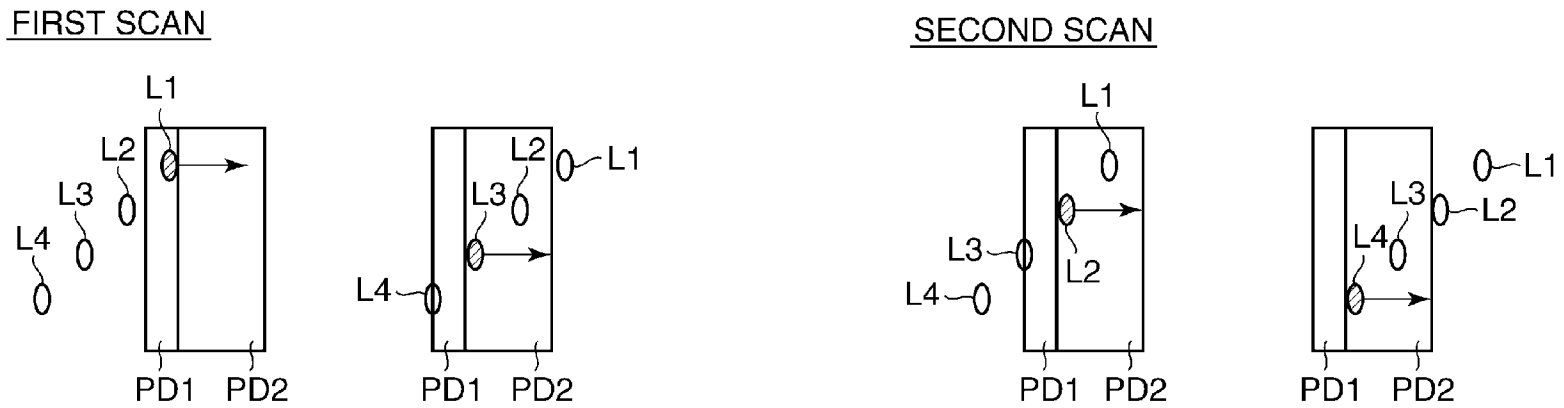
FIG.7A
FIG.7B
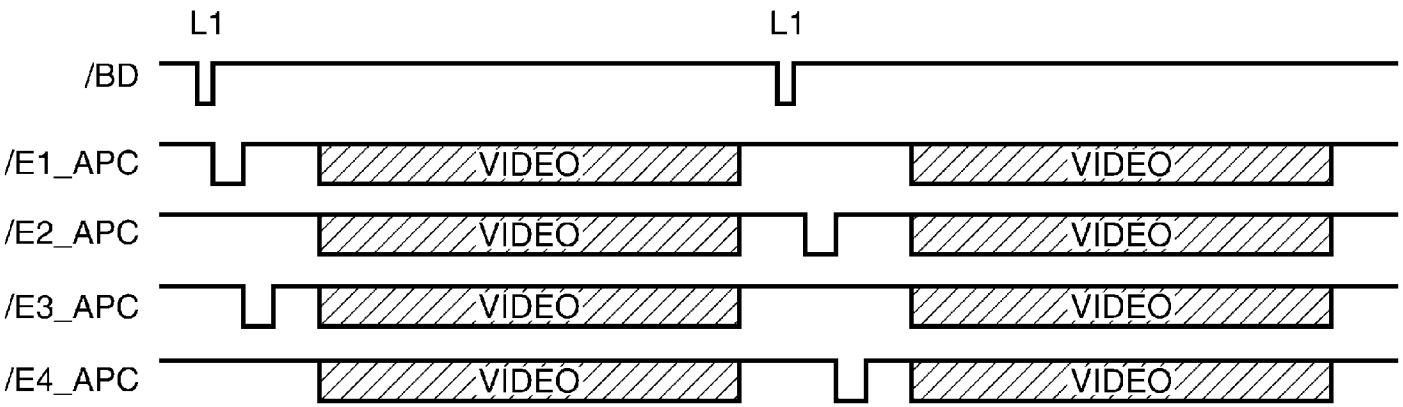
FIG.7C

LIGHT BEAM SCANNING DEVICE AND IMAGE FORMING APPARATUS THAT PERFORM LIGHT AMOUNT CONTROL

BACKGROUND OF THE INVENTION

1. Field of the Invention

The present invention relates to a light beam scanning device and an image forming apparatus, and more particularly to light amount control performed by an image forming apparatus, such as a laser beam printer, in scanning a photosensitive member using a plurality of light beams.

2. Description of the Related Art

In recent image forming apparatuses provided with a light beam scanning device, with a view to increasing the printing speed and enhancing the resolution of output images, the number of light emitting elements (light emitting points) provided in a light source, such as a semiconductor laser, is increased, whereby an image is formed by simultaneously scanning a photosensitive member using a plurality of light beams.

The image forming apparatuses that scan a photosensitive member using a plurality of light beams are capable of achieving higher printing speed and higher resolution of output images without increasing the rotational speed of a polygon mirror, compared with image forming apparatuses provided with a single light emitting element and increased in the rotational speed of a polygon mirror.

In increasing the number of light beams, it is envisaged to use a vertical cavity surface emitting laser (hereafter referred to as the VCSEL). The VCSEL is easier to increase the number of laser beams than an edge emitting laser (hereinafter referred to as the EEL).

The VCSEL emits light only in a direction perpendicular to a chip surface, and hence a VCSEL element cannot incorporate a photodiode for detecting a light amount of a light beam. For this reason, each image forming apparatus that uses the VCSEL as a writing light source is required to have a photodiode sensor provided outside the VCSEL. Based on the light amount of a light beam received and detected by the photodiode sensor, automatic power control (APC) of the light beam emitted from the VCSEL is performed.

As a method of performing the automatic power control based on the received light amount detected by the photodiode sensor, it is known to dispose one photodiode on a moving line (scanning line) along which a plurality of light beams converted to scanning light by the polygon mirror are scanned, and control the light amount of each of the light beams based on the amount of light received by the photodiode (Japanese Patent Laid-Open Publication No. H09-230259). This publication discloses a beam writing device which uses a plurality of light beams of which the width of a space interval in a moving direction (scanning direction) therebetween is made wider than the width of the photodiode so as to prevent more than one light beam from simultaneously entering the one photodiode. According to this publication, a result of light reception by the photodiode corresponds to an amount of one light beam since more than one light beam does not simultaneously enter the photodiode, which makes it possible to perform light amount control of each light beam with accuracy.

However, when the image forming apparatus is configured as in Japanese Patent Laid-Open Patent Publication No. H09-230259, it is required to make wider the width of space interval between adjacent light beams in the scanning direction thereof than the width of the photodiode. Then, it is required to increase the distance between light emitting elements that emit the adjacent light beams, which increases the size of the light source of the image forming apparatus.

On the other hand, if a plurality of light emitting elements are disposed such that the space interval between each adjacent ones of light beams in the scanning direction thereof is made narrower than the width of a photodiode, and the automatic power control is performed by lighting the plurality of light emitting elements in the order of arrangement thereof, adjacent light beams simultaneously enter the photodiode, which makes it impossible to perform light amount control of each light beam with accuracy. Let us consider, for example, a case where a light beam from a first light emitting element and a light beam from a second light emitting element are adjacent to each other in the scanning direction of light beams, and the light beam from the first light emitting element scans a photosensitive member, immediately before the light beam from the second light emitting element. When performing the automatic power control of the second light emitting element immediately after executing the automatic power control by causing the first light emitting element to emit the light beam, the automatic power control of the second light emitting element cannot be executed before turning off the first light emitting element. If the automatic power control of the second light emitting element is started before the first light emitting element is turned off, the light beam from the first light emitting element and the light beam from the second light emitting element enter the photodiode. A result of light reception detected by the photodiode contains a light mount of the light beam from the first light emitting element, and hence if the automatic power control is performed based on the result of light reception by the photodiode, the light amount of the light beam from the second light emitting element cannot be controlled to a predetermined light amount.

It can be envisaged that the automatic power control of the second light emitting element is started after waiting for the first light emitting element being subjected to the automatic power control to be completely extinguished. However, at the time of starting the automatic power control of the light beam from the second light emitting element, the light beam has already come to a point where it has entered the photodiode, and there is not sufficient time to complete the automatic power control before this light beam terminates scanning of the photodiode.

SUMMARY OF THE INVENTION

The present invention provides a light beam scanning device and an image forming apparatus that are capable of suppressing lowering of accuracy of light amount control executed when scanning a photosensitive member using a plurality of light beams.

In a first aspect of the present invention, there is provided a light beam scanning device comprising a light source including a plurality of light emitting elements configured to emit respective light beams for forming an electrostatic latent image on a photosensitive member, the plurality of light emitting elements including a first light emitting element and a second light emitting element, a deflection unit configured to deflect the light beams emitted respectively from the light emitting elements, such that each light beam scans the photosensitive member in a predetermined direction, a light receiving unit disposed at a position where enter the light beams deflected by the deflection unit, for receiving each light beam, and a control unit configured to perform light amount control for controlling an amount of light of each of the light beams emitted respectively from the light emitting elements, based on a result of reception of the light beam by the light receiving unit, wherein in the light source, the first light emitting element and the second light emitting element are arranged such that a light beam from the first light emitting element and a light beam from the second light emitting element are adjacent to each other in the predetermined direction, and that there occurs a time period during which both the light beam from the first light emitting element and the light beam from the second light emitting element enter the light receiving unit at the same time, and wherein the control unit executes the light amount control of the light beam from the first light emitting element and the light amount control of the light beam from the second light emitting element, at receptive different cycles of scanning of the light beams.

In a second aspect of the present invention, there is provided an image forming apparatus comprising a photosensitive member, a light source including a plurality of light emitting elements configured to emit respective light beams for forming an electrostatic latent image on the photosensitive member, the plurality of light emitting elements including a first light emitting element and a second light emitting element, a deflection unit configured to deflect the light beams emitted respectively from the light emitting elements, such that each light beam scans the photosensitive member in a predetermined direction, a light receiving unit disposed at a position where enter the light beams deflected by the deflection unit, for receiving each light beam, and a control unit configured to perform light amount control for controlling an amount of light of each of the light beams emitted respectively from the light emitting elements, based on a result of reception of the light beam by the light receiving unit, wherein in the light source, the first light emitting element and the second light emitting element are arranged such that a light beam from the first light emitting element and a light beam from the second light emitting element are adjacent to each other in the predetermined direction, and that there occurs a time period during which both the light beam from the first light emitting element and the light beam from the second light emitting element enter the light receiving unit at the same time, and wherein the control unit executes the light amount control of the light beam from the first light emitting element and the light amount control of the light beam from the second light emitting element, at receptive different cycles of scanning of the light beams.

According to the present invention, the light amount control of the light beam from the first light emitting element and the light amount control of the light beam from the second light emitting element are performed at respective different scanning cycles, and hence it is possible to suppress lowering of accuracy of the light amount control of the light beam from the first light emitting element and the light amount control of the light beam from the second light emitting element.

Further features of the present invention will become apparent from the following description of exemplary embodiments with reference to the attached drawings.

BRIEF DESCRIPTION OF THE DRAWINGS

FIGS. 7A to 7C are diagrams useful in explaining automatic power control at respective positions of scanning beams in the second sensor element appearing in FIG. 3, wherein FIG. 7A shows respective positions of scanning beams in a first scan; FIG. 7B shows respective positions of scanning beams in a second scan; and FIG. 7C is a timing diagram useful for explaining output from the photodiode sensor.

DESCRIPTION OF THE EMBODIMENTS

The present invention will now be described in detail below with reference to the accompanying drawings showing embodiments thereof.

Figure 1:
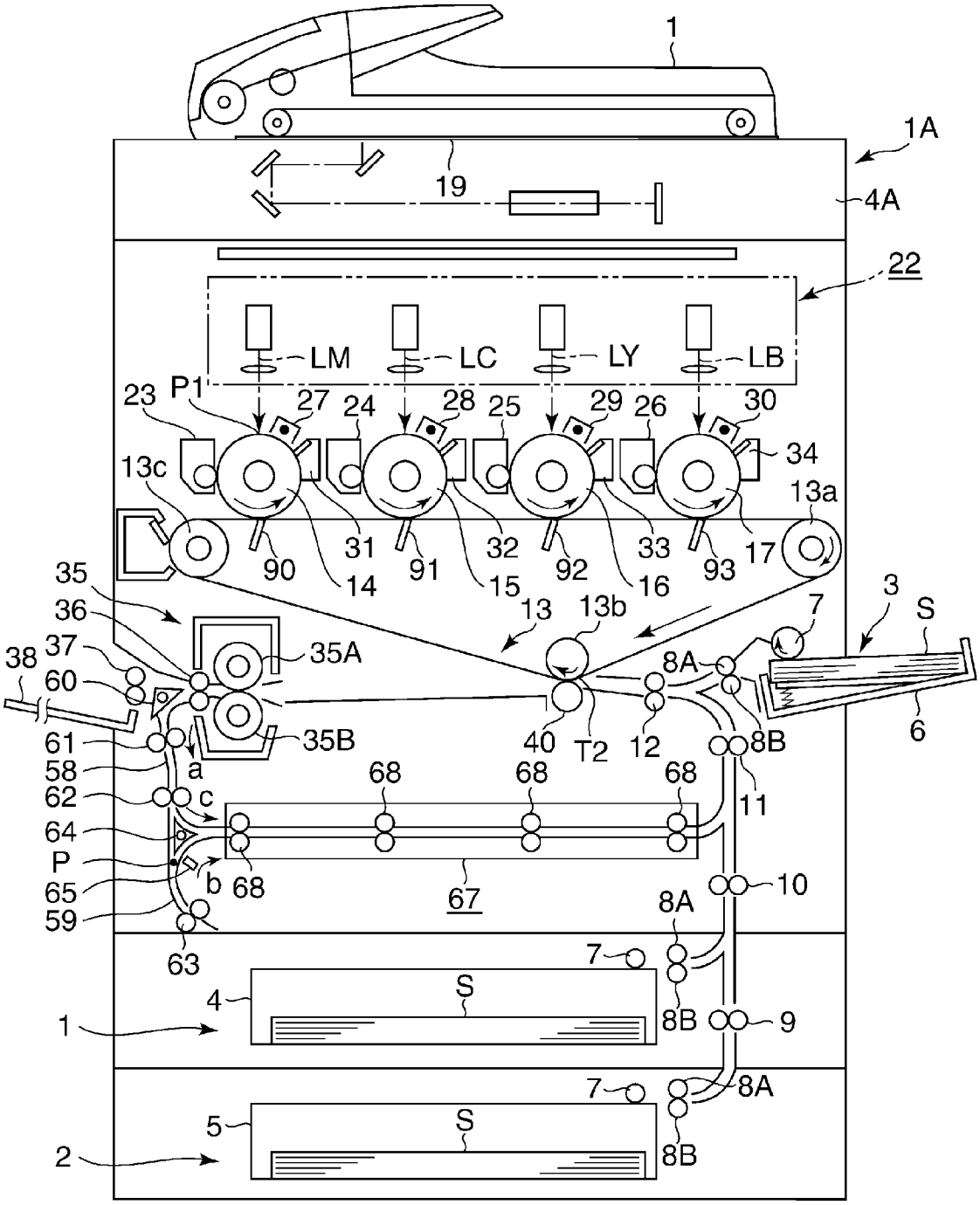
FIG. 1 is a schematic view of an image forming apparatus using a light beam scanning device according to a first embodiment of the present invention.

FIG. 1 is a schematic view of an image forming apparatus using a light beam scanning device according to a first embodiment of the present invention.

The image forming apparatus shown in FIG. 1 forms a color image by superimposing respective images of the colors of cyan (C), magenta (M), yellow (Y), and black (K) one upon another.

The image forming apparatus, denoted by reference numeral 1A, shown in FIG. 1 has four photosensitive drums 14, 15, 16, and 17 as photosensitive members. An intermediate transfer belt (endless belt) 13 as an intermediate transfer member is disposed in facing relation to the photosensitive drums 14, 15, 16, and 17.

The intermediate transfer belt 13 is stretched around a driving roller 13*a*, a secondary transfer opposed roller 13*b*, and a tension roller (driven roller) 13*c* such that the general shape of the intermediate transfer belt 13 in cross-sectional view is triangular. The intermediate transfer belt 13 rotates in a clockwise direction as viewed in FIG. 1 (i.e. in a direction indicated by a solid-line arrow in FIG. 1).

The photosensitive drums 14, 15, 16, and 17 are arranged along the direction of rotation of the intermediate transfer belt 13. In the illustrated example, the photosensitive drums 4, 15, 16, and 17 are arranged in the mentioned order from the most upstream side in a direction of rotation of the intermediate transfer belt 13.

Around the photosensitive drum 14, there are arranged an electrostatic charger 27, a developing device 23, and a cleaner 31. Similarly, arranged around each of the photosensitive drums 15, 16, and 17 are an associated one of electrostatic chargers 28, 29, and 30, an associated one of developing devices 24, 25, and 26, and an associated one of cleaners 32, 33, and 34.

The electrostatic chargers 27, 28, 29, and 30 uniformly charge the surfaces of the photosensitive drums 14, 15, 16, and 17, respectively.

A light beam scanning device (also referred to an exposure controller) 22 is disposed above the photosensitive drums 14, 15, 16, and 17, and scans the surfaces of the respective photosensitive drums 14, 15, 16, and 17 with laser beams (light beams), described hereinafter, according to image data.

Note that in the example shown in FIG. 1, the photosensitive drums 14, 15, 16, and 17 correspond to magenta (M) toner, cyan (C) toner, yellow (Y) toner, and black (K) toner, respectively.

Now, a description will be given of an image forming (printing) operation performed by the image forming apparatus 1A shown in FIG. 1.

The image forming apparatus 1A shown in FIG. 1 has two cassette sheet feeders 1 and 2 and a manual sheet feeder 3. Recording sheets (transfer sheets) S are selectively fed from the cassette sheet feeders 1 and 2 and the manual sheet feeder 3.

The cassette sheet feeders 1 and 2 have respective cassettes 4 and 5, and the manual sheet feeder 3 has a tray 6. Transfer sheets S are stacked on each of the cassettes 4 and 5 or the tray 6, and are picked up sequentially from an uppermost one by an associated pickup roller 7. Then, only the uppermost transfer sheet S is separated from the other picked-up sheets S by an associated separation roller pair 8 formed by a feed roller 8A and a retard roller 8B.

A transfer sheet S fed from the cassette sheet feeder 1 or 2 is conveyed to a registration roller pair 12 via a conveying roller pair 9 and/or a conveying roller pair 10, and a conveying roller pair 11. On the other hand, a transfer sheet S fed from the manual sheet feeder 3 is directly conveyed to the registration roller pair 12. Then, the conveyance of the transfer sheet S is temporarily stopped by the registration roller pair 12, and skew of the transfer sheet S is corrected.

The image forming apparatus 1A is provided with a document feeder 1, and the document feeder 1 sequentially feeds originals stacked thereon, one by one, onto an original platen glass 19. When an original is conveyed to a predetermined position on the original platen glass 19, a scanner unit 4A illuminates the surface of the original, and reflected light from the original is guided to a lens (not shown) via mirrors and so forth (not shown). Then, the reflected light forms an optical image on an image sensor unit (not shown).

The image sensor unit photoelectrically converts the formed optical image to an electric signal. The electric signal is input to an image processor (not shown). The image processor converts the electric signal to a digital signal and then performs required image processing on the digital signal to thereby generate image data.

The image data is input to the light beam scanning device (exposure controller) 22 directly or after having been temporarily stored in an image memory (not shown). The light beam scanning device 22 drives semiconductor lasers (not shown), according to the image data. This causes laser beams (light beams) to be emitted from the semiconductor lasers.

Each of the laser beams is irradiated onto the surface of an associated one of the photosensitive drums 14, 15, 16, and 17 via a scanning system, described hereinafter with reference to FIG. 2, which includes a rotary polygon mirror (hereinafter simply referred to as "the polygon mirror") 105. The laser beam is scanned on the surface of the associated one of the photosensitive drums 14, 15, 16, and 17 in the main scanning direction (i.e. along the rotational axis of each of the photosensitive drums 14, 15, 16, and 17).

Each of the photosensitive drums 14, 15, 16, and 17 rotates in a direction (sub scanning direction) indicated by a solid-line arrow in FIG. 1, so that the photosensitive drums 14, 15, 16, and 17 are each scanned in the sub scanning direction as well by the laser beams, and electrostatic latent images are formed on the respective photosensitive drums 14, 15, 16, and 17 according to the image data by the scanning of the laser beams.

In the illustrated example, first, the photosensitive drum 14 in the most upstream position is exposed by a laser beam LM based on image data of a magenta component. As a consequence, an electrostatic latent image is formed on the photosensitive drum 14. Then, the electrostatic latent image on the photosensitive drum 14 is developed by the developing device 23 into a magenta (M) toner image.

Then, when a predetermined time period has elapsed after the start of the exposure of the photosensitive drum 14, the photosensitive drum 15 is exposed by a laser beam LC based on image data of a cyan component. As a consequence, an electrostatic latent image is formed on the photosensitive drum 15. The electrostatic latent image on the photosensitive drum 15 is developed by the developing device 24 into a cyan (C) toner image.

Further, when the predetermined time period has elapsed after the start of the exposure of the photosensitive drum 15, the photosensitive drum 16 is exposed by a laser beam LY based on image data of a yellow component. As a consequence, an electrostatic latent image is formed on the photosensitive drum 16. The electrostatic latent image on the photosensitive drum 16 is developed by the developing device 25 into a yellow (Y) toner image.

Then, when the predetermined time period has elapsed after the start of the exposure of the photosensitive drum 16, the photosensitive drum 17 is exposed by a laser beam LB based on image data of a black component. As a consequence, an electrostatic latent image is formed on the photosensitive drum 17. The electrostatic latent image on the photosensitive drum 17 is developed by the developing device 26 into a black (K) toner image.

The M toner image on the photosensitive drum 14 is transferred onto the intermediate transfer belt 13 by a transfer charger 90. Similarly, the C toner image, the Y toner image, and the K toner image are transferred from the photosensitive drums 15, 16, and 17 onto the intermediate transfer belt 13 by transfer chargers 91, 92, and 93, respectively.

As a consequence, the M toner image, the C toner image, the Y toner image, and the K toner image are transferred onto the intermediate transfer belt 13 in superimposed relation, whereby a color toner image is formed as a primary transfer image on the intermediate transfer belt 13.

Note that toners remaining on the respective photosensitive drums 14, 15, 16, and 17 after the transfer of the toner images are removed by the cleaners 31, 32, 33, and 34, respectively.

The transfer sheet S temporarily stopped at the registration roller pair 12 is conveyed to a secondary transfer position T2 by the registration roller pair 12 being driven. In doing this, the registration roller pair 12 is driven for rotation in timing synchronous with alignment between the color toner image formed on the intermediate transfer belt 13 and the leading edge of the transfer sheet S, whereby the transfer sheet S is conveyed to the secondary transfer position T2.

At the secondary transfer position T2, there are disposed a secondary transfer roller 40 and the secondary transfer opposed roller 13*b*, and the color toner image on the intermediate transfer belt 13 is transferred as a secondary transfer image onto the transfer sheet S at the secondary transfer position T2.

The transfer sheet S having passed through the secondary transfer position T2 is conveyed to a fixing device 35. The fixing device 35 has a fixing roller 35A and a pressure roller 35B. The transfer sheet S is heated by the fixing roller 35A and pressed by the pressure roller 35B as it passes through a nip formed by the fixing roller 35A and the pressure roller 35B. As a consequence, the secondary transfer image is fixed on the transfer sheet S.

The transfer sheet S having undergone the fixing processing is conveyed to a discharge roller pair 37 by a conveying roller pair 36 and is discharged onto a discharge tray 38 by the discharge roller pair 37.

Incidentally, to meet the requirements of increased processing speed and enhanced image quality, it is a common practice to cause a semiconductor laser as a laser light source to emit a plurality of beams to thereby cause exposure of a plurality of scanning lines in a single scan using a polygon mirror.

Now, a description will be given of an example in which a multi-beam semiconductor laser is used in an image forming apparatus.

Figure 2:
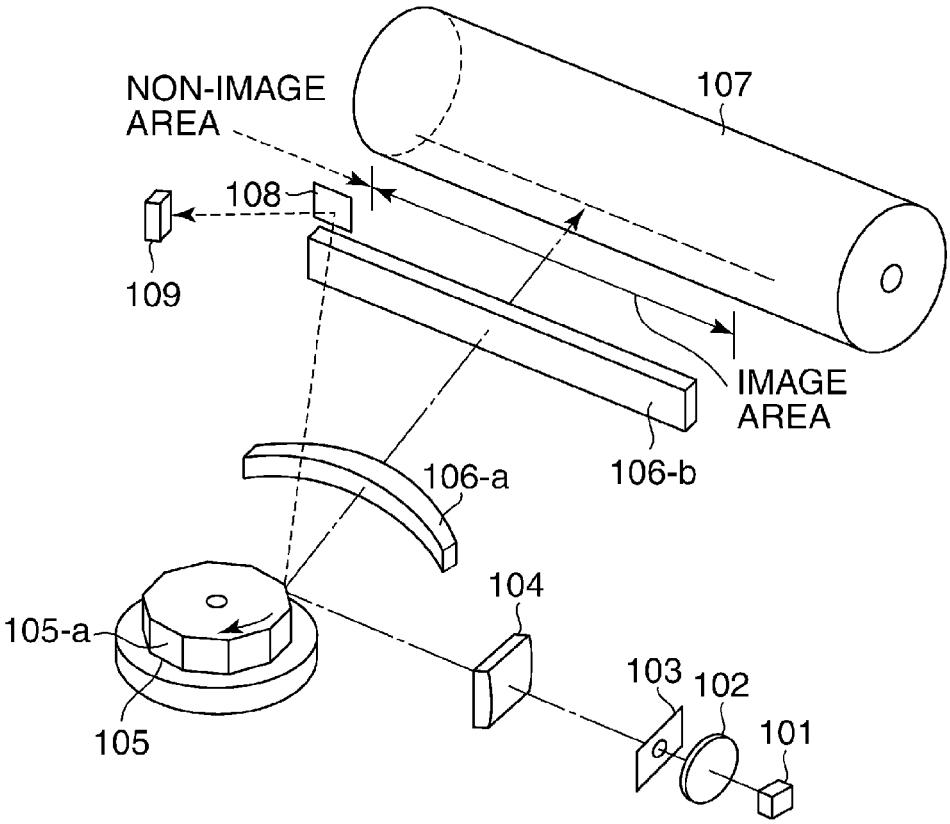
FIG. 2 is a diagram showing details of the light beam scanning device appearing in FIG. 1.

FIG. 2 is a diagram showing details of the light beam scanning device 22 appearing in FIG. 1.

Figure 9:
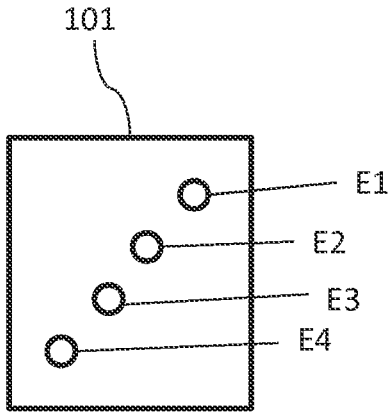
FIG. 9 is a diagram showing a light source including a plurality of light emitting elements.

Referring to FIG. 2, the light beam scanning device 22 illustrated therein uses a semiconductor laser (LD (laser diode) 101 in the illustrated example) as a light source, and the semiconductor laser has a plurality of light emitting elements (laser elements), including a first light emitting element, a second light emitting element, and a third light emitting element. FIG. 9 shows an embodiment of laser diode 101 including light emitting elements E1, E2, E3, and E4. The laser diode 101 emits a plurality of laser beams (light beams).

To meet the requirements of increased processing speed and enhanced image quality, the image forming apparatus 1A is configured such that the laser diode 101 emits a plurality of laser beams, and exposure of a plurality of scanning lines is performed in a single scan using the polygon mirror 105.

Each laser beam emitted from the laser diode 101 is converted by a collimator lens 102 to a substantially collimated beam, and has the luminous flux thereof limited by an aperture stop 103, whereby the laser beam with a predetermined beam diameter passes through a cylindrical lens 104. The cylindrical lens 104 has a predetermined refracting power with respect to a sub-scanning direction (rotating direction) of the photosensitive drum 107, and causes the laser beam to form an image on the a reflection plane 105-*a* of the polygon mirror 105 within the same cross-sectional plane in the sub-scanning direction.

The polygon mirror 105 is driven by a motor (not shown) for rotation at a uniform angular velocity. The laser beam is converted to a deflected beam which continuously changes its angle according to the rotation of the polygon mirror 105. Then, the deflected beam is scanned on the photosensitive drum 107 in a main scanning direction (along the rotational axis of the photosensitive drum 107) via a toric lens 106-*a* and a diffraction optical element 106-*b*, whereby an electrostatic latent image is formed on the photosensitive drum 107. Note that the above-mentioned toric lens 106-*a* is configured such that a lens surface thereof in the main scanning direction is aspherical.

As shown in FIG. 2, a reflection mirror 108 is disposed in an area (hereafter referred to as the non-image area) outside an image area of a light scanning area of the photosensitive drum 107 which provides an exposed surface, and a scanning light (laser beam) reflected from the reflection mirror 108 enters a photodiode (PD) sensor 109 as a beam detection sensor. In short, the laser beam deflected by the polygon mirror 105 for scanning is reflected by the reflection mirror 108, and thereby scans a light receiving surface of the PD sensor 109.

The PD sensor 109 detects a laser beam having entered the light receiving surface, and outputs a result of light reception, i.e. a detection signal. Then, according to detection timing of the laser beam, the writing start timing of an image onto the photosensitive drum 107 is controlled. Further, the automatic power control (APC) is performed on the laser diode 101, such that the received light amount of the light beam received by the PD sensor 109 becomes equal to a predetermined light amount.

In performing the automatic power control, the laser diode 101 is lit for a predetermined time period, and an light amount of the laser beam is detected by the PD sensor 109. Then, according to the detected light amount, the drive current supplied to the laser diode 101 is controlled. In doing this, the automatic power control is performed on a scanning line-by-scanning line basis in a non-image region of scanning lines.

In the illustrated example, the photodiode sensor 109, which is a so-called two-division photodiode sensor, receives scanning light, and detects an image writing start position (exposure start position: BD) and a light amount, whereby the automatic power control is performed based on the detected light amount.

Figure 3:
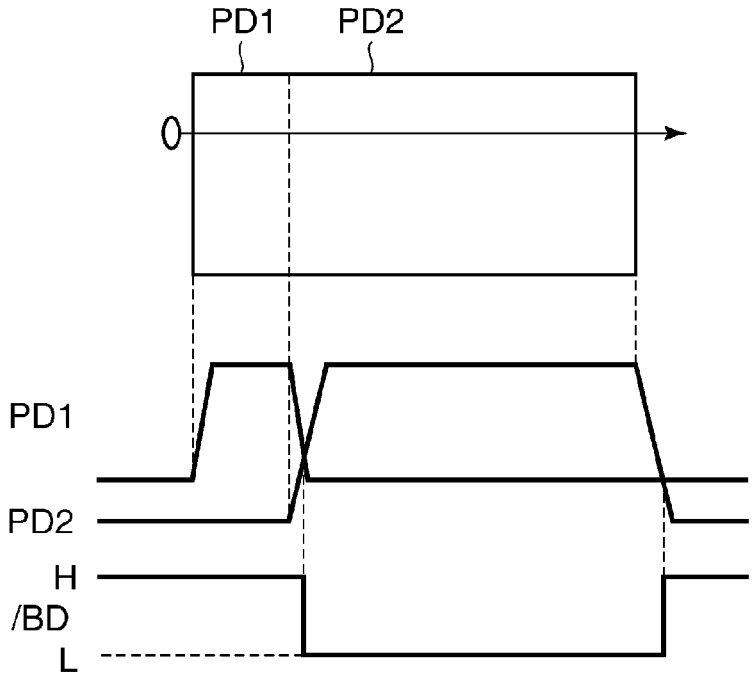
FIG. 3 is a diagram showing an output waveform of a photodiode sensor appearing in FIG. 2 and an image writing start position.

FIG. 3 is a diagram showing an output waveform of a photodiode sensor 109 appearing in FIG. 2 and an image writing start position (BD).

In FIG. 3, the photodiode sensor 109 comprises a first sensor element PD1 and a second sensor element PD2 (a first light receiving element and a second light receiving element). The second sensor element PD2 is disposed at a location downstream of the first sensor element PD1 in the direction of scanning of laser beams (scanning light). When the scanning light is scanned on the light receiving surface of the photodiode sensor 109, first, a first beam detection signal is output from the first sensor element PD1, and then, a second beam detection signal is output from the second sensor element PD2.

In FIG. 3, the first and second beam detection signals are presented by PD1 and PD2. The first sensor element PD1 is disposed in abutment with one end of the second sensor element PD2 (on an upstream side thereof in the direction of scanning of laser beams) in a manner integral therewith. The first sensor element PD1 is scanned by a laser beam before the second sensor element PD2 is scanned by the same. The first sensor element PD1 is scanned by the laser beam in a direction from one end to the other end thereof.

A BD (beam detection) signal, i.e. a synchronization signal is generated by comparing the first and second beam detection signals PD1 and PD2. More specifically, as shown in FIG. 3, when the level of the first beam detection signal PD1 becomes not higher than that of the second beam detection signal PD2, the BD signal is changed from a high (H) level to a low (L) level. Then, when the level of the first beam detection signal PD1 becomes higher than that of the second beam detection signal PD2, the BD signal is changed from the low level to the high level.

In the illustrated example, to prevent erroneous detection caused by noise or the like, a lower limit of the first beam detection signal PD1 is clipped. Then, using the BD signal (synchronization signal) as a trigger, the automatic power control is performed.

Note that, it is only required that the timing of the automatic power control can be determined such that the automatic power control is performed when the scanning light scans the second sensor element PD2, and hence the signal used as a trigger is not required to be the synchronization signal, but any suitable signal may be used insofar as it detects that the laser beam as a reference has passed the second sensor element PD2. For example, a threshold value may be set for an output from the second sensor element PD2, and a signal may be used which is logically inverted when the output exceeds the threshold value.

Figure 4:
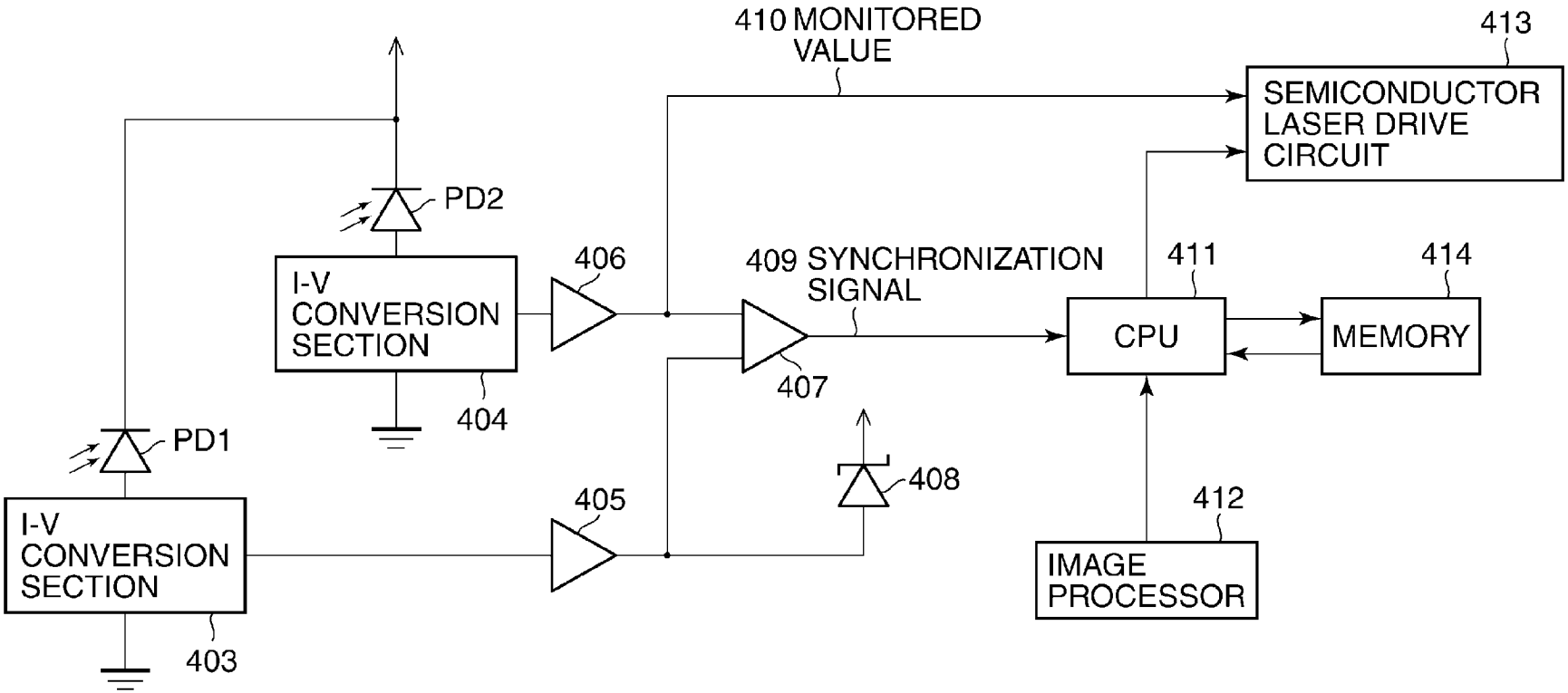
FIG. 4 is a block diagram of a control system of the light beam scanning device shown in FIG. 2.

FIG. 4 is a block diagram of a control system (also referred to as the light scan controller) of the light beam scanning device shown in FIG. 2.

With reference to FIG. 2 and FIG. 4, first, one light emitting element (e.g. light emitting element which is first lit) of the laser diode 101 appearing in FIG. 2 is fully lit by constant current, and then photodiode sensor 109 is scanned by a laser beam. This generates the BD signal (synchronization signal) as mentioned above. At this time, the light emitting element is fully lit so as to reduce jitter in generation of the synchronization signal by causing the photodiode sensor 109 to steeply respond to the laser beam.

After detecting the synchronization signal, a CPU 411, referred to hereinafter, causes a semiconductor laser drive circuit 413 to shift to an APC mode in which the automatic power control is executed, whereby a light emitting element that scans the second sensor element PD2, as an object to be subjected to the automatic power control, is lit. In doing this, if a light emitting element for BD detection and a light emitting element to be subjected to the automatic power control are different from each other, an automatic power control sequence is started by shifting a phase by a spacing amount of pitch of the elements in an array.

Current generated in the first sensor element PD1 by scanning of the laser beam is converted to voltage by an I-V (current-voltage) conversion section 403, and is then amplified by an amplifier 405. An output of the amplifier 405 is connected to a Zener diode 408, whereby an output from the amplifier 405 (i.e. the first beam detection signal) is clipped. Similarly, current generated in the second sensor element PD2 is converted to voltage (second voltage) by an I-V (current-voltage) conversion section 404, and is then amplified by an amplifier 406.

The output from the amplifier 405 and the output from the amplifier 406 (i.e. the second beam detection signal) are input to a comparator 407 (synchronization signal generation unit). The comparator 407 compares the first and second beam detection signals with each other, and according to a result of the comparison, outputs the synchronization signal, denoted by reference numeral 409, as described above. Then, the synchronization signal 409 is input to the CPU 411. Note that the second beam detection signal is supplied to the semiconductor laser drive circuit 413 as a monitored value 410.

Image data processed by an image processor 412 (image data input unit) provided for the image forming apparatus 1A is supplied to the CPU 411. A memory 414 stores a time period required for the automatic power control, which was measured in advance, as a convergence time period. The CPU 411 causes the semiconductor laser drive circuit 413 to perform the automatic power control over the time period (convergence time period) required for the automatic power control.

Next, a description will be given of how to switch laser beams after completion of the automatic power control.

Figure 5:
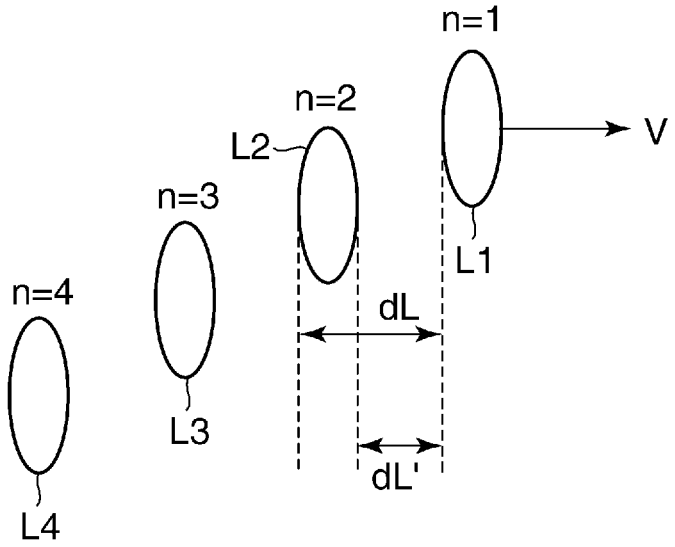
FIG. 5 is a diagram showing a plurality of laser beams that scan a second sensor element appearing in FIG. 3.

FIG. 5 is a diagram showing a plurality of (n) laser beams (n is an integer which is not smaller than 2) that scan the second sensor element appearing in FIG. 3. In the following description, it is assumed for convenience that n=4 holds, and the laser diode 101 appearing in FIG. 2 has four light emitting elements E1 to E4, and that laser beams emitted from the light emitting elements E1 to E4 are represented by reference numerals L1 to L4, respectively. In FIG. 5, laser beams L1 to L4 emitted from the four light emitting elements (E1, E2, E3 and E4) are shown, and these laser beams L1 to L4 are scanned on the second sensor element PD2 at a beam scanning speed v.

FIGS. 7A to 7C are diagrams useful in explaining how the laser beams emitted from the four light emitting elements scan the photodiode sensor 109. L1 represents a laser beam emitted from the light emitting element E1, and in FIGS. 7A and 7B, a corresponding illuminating position thereof is indicated. Similarly, L2 represents a laser beam emitted from the light emitting element E2, and in FIGS. 7A and 7B, a corresponding illuminating position thereof is indicated. L3 represents a laser beam emitted from the light emitting element E3, and in FIGS. 7A and 7B, a corresponding illuminating position thereof is indicated. L4 represents a laser beam emitted from the light emitting element E4, and in FIGS. 7A and 7B, a corresponding illuminating position thereof is indicated. Note that in FIGS. 7A and 7B, a light emitting element corresponding to an illuminating position represented by a hatched ellipse is in a lit state, whereas a light emitting element corresponding to an illuminating position represented by a non-hatched ellipse is in a non-lit state.

FIG. 7A shows respective positions of scanning beams in a first scan, including scanning beams emitted from light emitting elements caused to emit light for executing the automatic power control in the first scan, and FIG. 7B shows respective positions of scanning beams in a second scan, including scanning beams emitted from light emitting elements caused to emit light for executing the automatic power control in the second scan. Further, as described hereinafter, FIG. 7C is a timing diagram useful for explaining output from the photodiode sensor 109 in the case of FIGS. 7A and 7B, in which light emitting timing of each of the light emitting elements E1 to E4 during image formation (video mode of the semiconductor laser drive circuit 413) is shown.

As shown in FIGS. 7A and 7B, the automatic power control of the light emitting element E1 and that of the light emitting element E3 are executed in the first scan, and the automatic power control of the light emitting element E2 and that of the light emitting element E4 are executed in the second scan. More specifically, in the light beam scanning device or the image forming apparatus according to the present embodiment, light beams adjacent to each other in the scanning direction are subjected to the automatic power control at respective different scanning cycles.

As shown in a left part of FIG. 7A, first, a laser beam L1 enters the second sensor element PD2. The CPU 411 controls the amount of current supplied to the light emitting element E1 based on an output from the photodiode sensor 109 such that the light amount of the laser beam L1 becomes equal to a predetermined light amount. In a right part of FIG. 7A, there is shown a state in which each laser beam has been moved (scanned) from a state shown in the left part of FIG. 7A in a direction of an arrow in FIG. 7A and the automatic power control of the light emitting element E1 has been completed. In this state, the position of a spot of the laser beam L2 emitted from the light emitting element E2 is as shown therein. In this case, before the automatic power control of the light emitting element E2 is completed, the laser beam L2 enters the second sensor element PD2. For this reason, in the first scan, the automatic power control of the light emitting element E2 is not executed, but the automatic power control of the light emitting element E3 is executed from which the laser beam L3 is emitted to enter the second sensor element PD2 immediately after the laser beam L1 from the light emitting element E1 has passed through the second sensor element PD2. The relationship in timing of execution of the automatic power control is indicated by light emission mode-switching control signals /E1_APC and /E3_APC.

On the other hand, the CPU 411 executes, in the second scan, the automatic power control of the light emitting element E2 and that of the light emitting element E4 for which the automatic control has not been executed in the first scan. As shown in a left part of FIG. 7B, at this time, the light emitting element E1 is controlled to a non-lit state, while the light emitting element E2 is controlled to a lit state. The CPU 411 controls the value of current based on the output from the photodiode sensor 109 such that the light amount of the laser beam L2 becomes equal to the predetermined light amount. In a right part of FIG. 7B, there is shown a state in which each laser beam has been moved (scanned) from a state shown in the left part of FIG. 7B in a direction of an arrow in FIG. 7A and the automatic power control of the light emitting element E2 has been completed. In this state, the position of a spot of the laser beam L2 emitted from the light emitting element E2 is as shown therein. In this case, before the automatic power control of the light emitting element E2 is completed, the laser beam L3 enters the second sensor element PD2. For this reason, in the second scan, the automatic power control of the light emitting element E3 is not executed, but the automatic power control of the light emitting element E4 is executed from which the laser beam L4 is emitted to enter the second sensor element PD2 immediately after the laser beam L2 from the light emitting element E2 has passed through the second sensor element PD2. The relationship in timing of execution of the automatic power control is indicated by light emission mode-switching control signals /E2_APC and /E4_APC. Note that the light emission mode-switching control signals /E1_APC, /E2_APC, /E3_APC and /E4_APC are generated by the CPU 411 and supplied to the semiconductor laser drive circuit 413.

Now, when the light amount adjustment of a light emitting element (E1 in the illustrated example in FIG. 7A) subjected to the automatic power control is completed, the CPU 411 selects a light emitting element (E3 in the illustrated example in FIG. 7A) which corresponds to a laser beam positioned closest to an end of the second sensor element PD2 (end toward the first sensor element PD1) as a light emitting element to be subjected to the automatic power control. Then, the CPU 411 instructs the semiconductor laser drive circuit 413 to start the automatic power control of the selected light emitting element.

More specifically, the CPU 411 selects, based on the convergence time period for the automatic power control, a beam pitch on the second sensor element PD2, a beam spot diameter, and scanning speed which are stored in the memory, a light emitting element corresponding to a laser beam which is closest to the end of the second sensor element PD2 toward the first sensor element PD1, as the light emitting element to be subjected to the automatic power control next.

For example, the CPU 411 identifies, as the light emitting element to be subjected to the automatic power control, a light emitting element corresponding to a laser beam represented by a smallest one of beam numbers indicative of laser beams satisfying the condition of the following equation (1):

$$(n-2)\times dL+dL'>v\times(tapc) \quad (1)$$

wherein dL represents a beam pitch on the second sensor element PD2, dL' is a value obtained by subtracting the spot diameter from the beam pitch, i.e. a distance between adjacent spots, and tapc is a time period required for the light amount control (APC convergence time period), as shown in FIG. 5.

Figure 6:
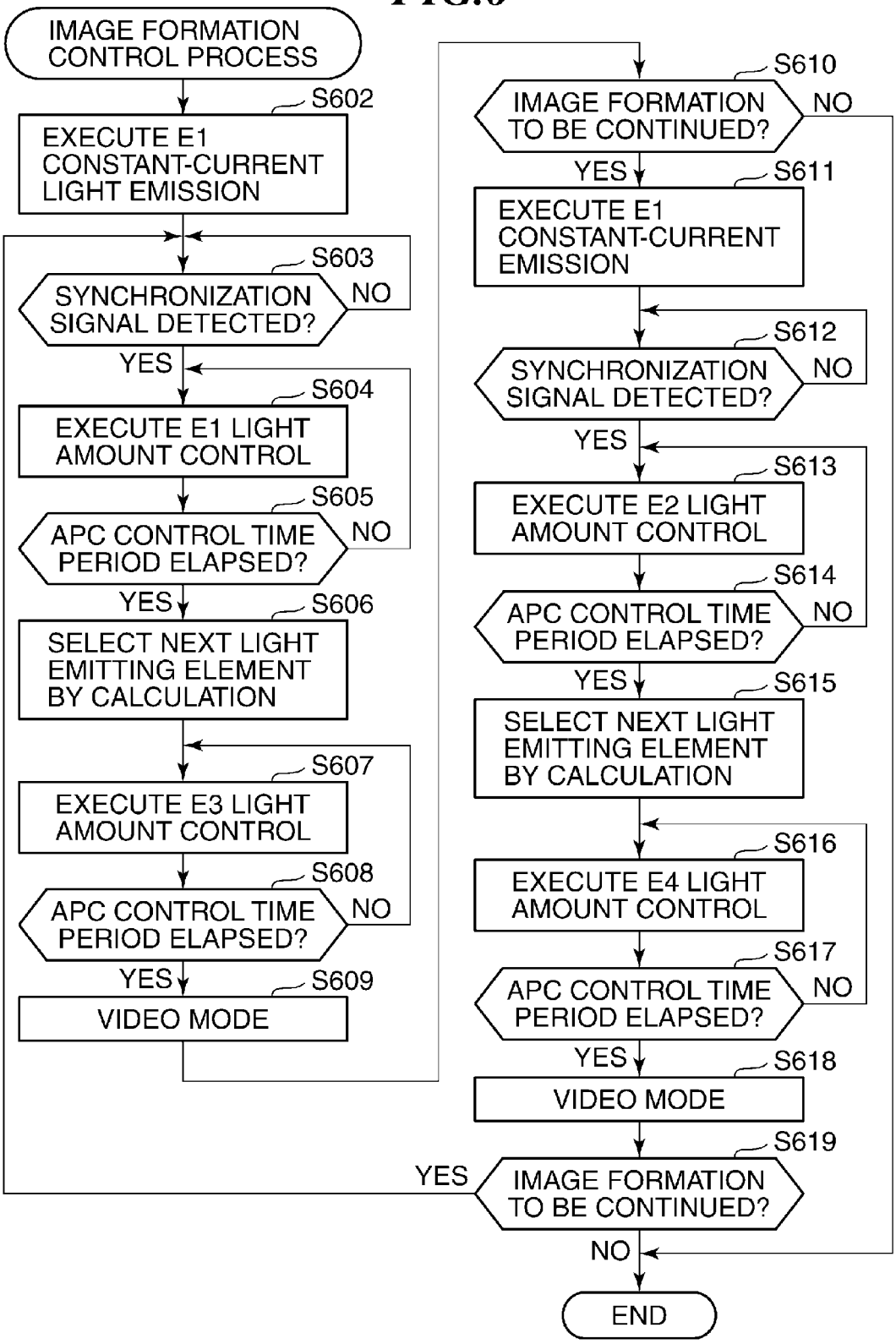
FIG. 6 is a flowchart of an image formation control process executed by a CPU appearing in FIG. 4.

FIG. 6 is a flowchart of an image formation control process executed by the CPU 411 appearing in FIG. 4.

Referring to FIGS. 4, 6, and 7A to 7C, now, when the image forming sequence is started, the CPU 411 drivingly controls the semiconductor laser drive circuit 413 to thereby cause the light emitting element E1 to emit light with constant current (step S602). Then, it is determined whether or not synchronization signal detection has occurred, i.e. the synchronization signal (BD) has been received (step S603). If the synchronization signal has not been received (NO to the step S603), the CPU 411 continues to cause the light emitting element E1 to emit light with constant current.

On the other hand, if it is determined that the synchronization signal has been received (YES to the step S603), the CPU 411 causes the semiconductor laser drive circuit to shift to the APC mode to start the automatic power control (light amount control) (step S604). The CPU 411 determines whether or not a predetermined APC control time period (APC convergence time period) has elapsed (step S605). If it is determined that the predetermined APC control time period has not elapsed (NO to the step S605), the CPU 411 returns to the step S604 to continue the automatic power control of the light emitting element E1.

If it is determined that the APC control time period has elapsed (YES to the step S605), a light emitting element to be subjected to the automatic power control next is selected by calculation, as described hereinabove (step S606). For example, assuming that the light emitting element to be subjected to the automatic power control next is the light emitting element E3, the CPU 411 drivingly controls the semiconductor laser drive circuit 413 to thereby execute automatic power control of the light emitting element E3.

Then, the CPU 411 determines again whether or not the APC control time period has elapsed (step S608). If it is determined that the APC control time period has not elapsed (NO to the step S608), the CPU 411 returns to the step S607 to continue the automatic power control of the light emitting element E3.

If it is determined that the APC control time period has elapsed (YES to the step S608), the CPU 411 causes the semiconductor laser drive circuit 413 to shift from the APC mode to the video (image) mode. Then, the CPU 411 drivingly controls the semiconductor laser drive circuit 413 according to image data, thereby causing the light emitting elements E1 to E4 of the laser diode 101 to emit light, for this single scan which has been started with execution of the automatic power control on the light emitting elements E1 and E3.

Next, the CPU 411 determines whether or not to continue image formation (step S610). If it is determined not to continue image formation (NO to the step S610), the CPU 411 immediately terminates the present image formation control process On the other hand, if it is determined to continue image formation (YES to the step S610), the CPU 411 drivingly controls the semiconductor laser drive circuit 413 to thereby cause the light emitting element E1 to emit light with constant current (step S611). Then, the CPU 411 determines whether or not the synchronization signal has been received (step S612). If it is determined that the synchronization signal has not been received (NO to the step S612), the CPU 411 continues to cause the light emitting element E1 to emit light with constant current.

On the other hand, if it is determined that the synchronization signal has been received (YES to the step S612), the CPU 411 selects the light emitting element E2 which is different from the light emitting element subjected to the automatic power control in the immediately preceding scan, and causes the semiconductor laser drive circuit 413 to shift to the APC mode to start the automatic power control (light amount control) of the light emitting element E2 (step S613). Then, the CPU 411 determines whether or not the APC control time period has elapsed (step S614). If it is determined that the APC control time period has not elapsed (NO to the step S614), the CPU 411 returns to the step S613 to continue the automatic power control of the light emitting element E2.

If it is determined that the APC control time period has elapsed (YES to the step S614), the CPU 411 selects a light emitting element to be subjected to the automatic power control next by calculation as described hereinabove (step S615). For example, assuming that the light emitting element to be subjected to the automatic power control next is the light emitting element E4, the CPU 411 drivingly controls the semiconductor laser drive circuit 413 to thereby execute automatic power control of the light emitting element E4 (step S616).

Then, the CPU 411 determines again whether or not the APC control time period has elapsed (step S617). If it is determined that the APC control time period has not elapsed (NO to the step S617), the CPU 411 returns to the step S616 to continue the automatic power control of the light emitting element E4.

If it is determined that the APC control time period has elapsed (YES to the step S617), the CPU 411 causes the semiconductor laser drive circuit 413 to shift to the video mode (step S618). Then, the CPU 411 drivingly controls the semiconductor laser drive circuit 413 according to image data, thereby causing the light emitting elements E1 to E4 of the laser diode 101 to emit light, for this single scan which has been started with execution of the automatic power control on the light emitting elements E2 and E4.

Next, the CPU 411 determines whether or not to continue image formation (step S619). If it is determined not to continue image formation (NO to the step S619), the CPU 411 terminates the image forming sequence. On the other, if it is determined to continue image formation (YES to the step S619), the CPU 411 returns to the step S603 to continue the present processing.

Thus, by executing the above-described image formation control process, it is possible to perform the automatic power control on a plurality of laser beams in a single scan.

In the first embodiment described above, at timing where a light beam enters the second sensor element, the automatic power control is started, and hence it is possible to prevent the automatic power control on a single light beam from taking a longer time period. As a result, it is possible to prevent image quality from being made nonuniform due to variation in light amount.

Next, a description will be given of a light beam scanning device according to a second embodiment.

In the second embodiment, similarly to the first embodiment, scanning light is received by the two-division photodiode sensor 109, whereby the detection of an image writing start position and the automatic power control are performed.

Figure 8:
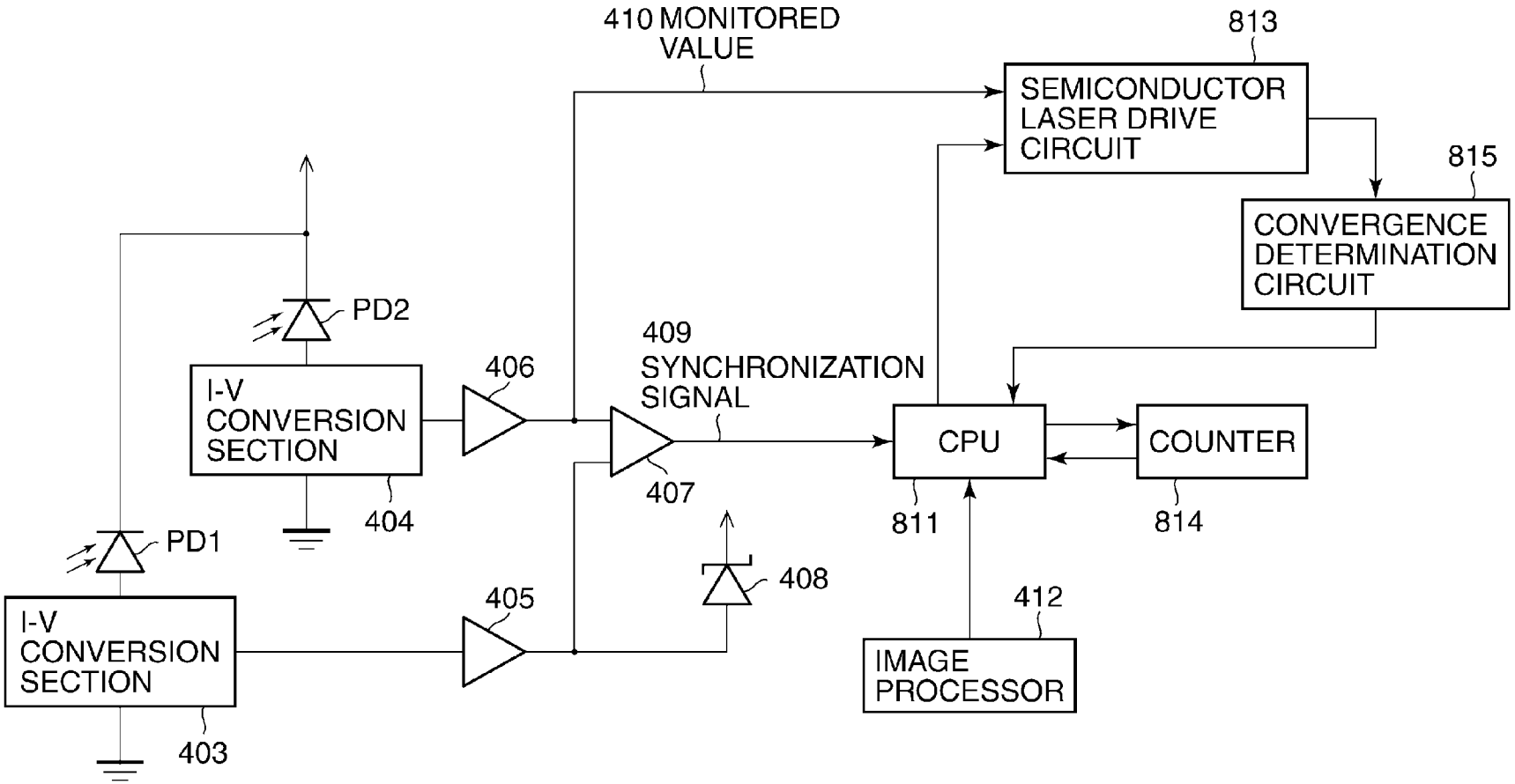
FIG. 8 is a block diagram of a control system used in a light beam scanning device according to a second embodiment of the present invention.

FIG. 8 is a block diagram of a control system used in the light beam scanning device according to the second embodiment. In the second embodiment, the same components of the control system as those of the control system shown in FIG. 4 are denoted by the same reference numerals, and description thereof is omitted. Further, a CPU and a semiconductor laser drive circuit of the present embodiment are different in function from the CPU 411 and the semiconductor laser drive circuit 413 of the first embodiment, and hence they are denoted by reference numeral 811 and 813, respectively.

The illustrated control system (also referred to as the light beam scanning device controller) includes a convergence determination circuit (convergence determination unit) 815 and a counter 814. As described hereinabove as to the first embodiment, when a synchronization signal is detected, the CPU 811 causes the semiconductor laser drive circuit 813 to shift to the APC mode to thereby cause a light emitting element to be subjected to the automatic power control to emit light. At this time, the CPU 811 causes the counter 814 to start counting up. The counter 814 is provided for measuring a time period (convergence time period) required for convergence of the automatic power control.

Current generated in the second sensor element PD2 is converted to voltage by the I-V conversion section 404, amplified by the amplifier 406, and then supplied to the semiconductor laser drive circuit 813 as a monitored value.

The monitored value 410 is passed from the semiconductor laser drive circuit 813 to the convergence determination circuit 815, and the convergence determination circuit 815 determines whether or not the monitored value 410 (light amount level) has converged to a predetermined target value (target light amount level).

Until the convergence determination circuit 815 determines the monitored value 410 has converged to the target value, the CPU 811 drivingly controls the semiconductor laser drive circuit 815 to continue execution of the automatic power control of the light emitting element.

On the other hand, if the convergence determination circuit 815 determines that the monitored value 410 has converged to the target value, the CPU 811 switches the light emitting element to be subjected to the automatic power control i.e. the target of the automatic power control. In doing this, the CPU 811 reads a count value of the counter 814 and clears (resets) the counter 814.

When the convergence determination circuit 815 determines that the light amount of the light emitting element as the target of the automatic power control has converged to the target value, the convergence determination circuit 815 sends a convergence detection signal to the CPU 811. In response to this, the CPU 811 selects, based on the count value of the counter 814 (APC convergence time period), the beam pitch on the second sensor element PD2, the beam spot diameter, and scanning speed, a laser beam positioned closest to an end of the second sensor element PD2 toward the first sensor element PD1 as a light emitting element to be subjected to the automatic power control next. This laser beam selection is executed based on the aforementioned equation (1).

In the second embodiment, the convergence determination circuit determines whether or not the light amount monitored by the convergence determination circuit has become equal to the target light amount, and hence it is possible to minimize the time period required for the automatic power control per laser beam, whereby it is possible to increase the number of beams which can be subjected to the automatic power control during a single scan.

Next, a third embodiment of the present invention will be described. The third embodiment is distinguished from the first and second embodiments described above in processing executed when the scanning speed of laser beams has changed, but is similar in the other points of basic configuration, and hence only different points will be described. In general, the scanning speed of laser beams is changed in the following cases: one in which the rotational speed of the polygon mirror is reduced to adapt the printing operation to high resolution printing, and the other in which in printing on a thick sheet, the processing speed is lowered so as to cause toner to be appropriately fixed.

When the rotational speed of the polygon mirror is changed depending on high-resolution printing or sheet type, a light emitting element to be subjected to the automatic power control is switched according to the processing speed. According to a change in the processing speed, the scanning speed of a laser beam passing through the photodiode sensor changes. This makes it necessary to change the light emitting element to be subjected to the automatic power control.

Although not shown, the processing speed is input to the CPU 411 appearing in FIG. 4 or the CPU 811 appearing in FIG. 8, and when the processing speed is changed, the CPU 411 or the CPU 811 determines the light emitting element to be subjected to the automatic power control according to the changed processing speed in each of the steps S606 and S615 described with reference to FIG. 6.

In the third embodiment, the light emitting element to be subjected to the automatic power control is switched according to a change in the processing speed caused e.g. by a change in the image mode, and hence it is possible to efficiently perform the automatic power control on all of the laser beams, according to the processing speed.

Next, a fourth embodiment of the present invention will be described. The fourth embodiment is distinguished from the first to third embodiments described above in processing in which a light emitting element of which the automatic power control has been completed is extinguished (turned off), and a light emitting element to be subjected to the automatic power control next is lit (turned on) to execute the automatic power control, but is similar in the other points of basic configuration, and hence only different points will be described.

Referring to FIG. 7. when the automatic power control of the light emitting element E1 corresponding to the laser beam L1 is completed, the CPU 411 or the CPU 811 executes extinguishing (turn-off) of the light emitting element E1 and lighting (turn-on) of the light emitting element E2 at the same timing. By causing the light emitting elements E1 and E2 to be simultaneously lit and extinguished, respectively, the second sensor element PD2 is continuously irradiated with a laser beam.

This means that the automatic power control can be shifted to a next light emitting element without causing a significant change in the output current from the second sensor element PD2. In other words, for a following light emitting element to be subjected to the automatic power control, the CPU 411 or 811 can immediately start the automatic power control without waiting for a rise time of the second sensor element PD2.

As a result, it is possible to reduce the APC convergence time for the following light emitting element. Note that for a second scan, the same control is performed on the light emitting elements E2 and E4 corresponding to the laser beams L2 and L4, respectively, as performed for the first scan.

In the fourth embodiment, the extinguishing of one light emitting element and the lighting of the other light emitting element are executed at the same timing, and hence the amount of light entering the second sensor element PD2 does not change significantly, and it is possible to perform the automatic power control immediately on another light emitting element without waiting for the lapse of a rise time of the second sensor element PD2.

The present invention has been described heretofore based on the embodiments thereof. However, the present invention is not limited to these embodiments, but it is to be understood that the invention includes various forms within the scope of the gist of the present invention.

For example, a control method based on the functions of the above-described embodiments may be caused to be executed by the light beam scanning device. Further, a control program implement the functions of the above-described embodiments may be caused to be executed by a computer provided in the light beam scanning device. The control program is stored e.g. in a computer-readable storage medium.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2011-010752 filed Jan. 21, 2011, which is hereby incorporated by reference herein in its entirety.

What is claimed is:

1. A light beam scanning device comprising:

a light source including a plurality of light emitting elements configured to emit light beams respectively for forming an electrostatic latent image on a photosensitive member, said plurality of light emitting elements including a first light emitting element, a second light emitting element, and a third light emitting element;

a deflection unit configured to deflect the light beams emitted respectively from said light emitting elements, such that each light beam scans the photosensitive member in a predetermined direction;

a light receiving unit configured to receive the light beams deflected by said deflection unit, for receiving each light beam; and a control unit configured to perform light amount control for controlling an amount of light of each of the light beams emitted respectively from said light emitting elements, based on a result of reception of the light beam by said light receiving unit, wherein in said light source, said first light emitting element and said second light emitting element are arranged such that both a light beam from said first light emitting element and a light beam from said second light emitting element enter said light receiving unit at the same time and a light beam from said third light emitting element and the light beam from said first light emitting element do not enter said light receiving unit at the same time, and the light beam from said first light emitting element and the light beam from said second light emitting element are adjacent to each other in the predetermined direction, and wherein said control unit executes the light amount control of the light beam from said first light emitting element and the light amount control of the light beam from said second light emitting element, in receptive different cycles of scanning of the light beams, and executes the light amount control of the light beam from said first light emitting element and the light amount control of the light beam from said third light emitting element, in the same cycle of scanning of the light beams.

2. The light beam scanning device according to claim 1, wherein said light receiving unit includes a first light receiving part configured to receive a light beam from a predetermined one of said plurality of light emitting elements to thereby generate a synchronization signal for controlling timing of emission of the light beam from each of said plurality of light emitting elements, and a second light receiving part disposed downstream of said first light receiving in a direction of scanning the light beams and configured to receive each of said plurality of light beams for enabling said control unit to execute the light amount control for said plurality of light emitting elements, wherein said control unit controls timing of lighting of each of said plurality of light emitting elements, based on the synchronization signal, such that a light beam from one of said plurality of light emitting elements enters said second light receiving part.

3. An image forming apparatus comprising:

a photosensitive member;

a light source including a plurality of light emitting elements configured to emit light beams respectively for forming an electrostatic latent image on said photosensitive member, said plurality of light emitting elements including a first light emitting element, a second light emitting element, and a third light emitting element;

a deflection unit configured to deflect the light beams emitted respectively from said light emitting elements, such that each light beam scans the photosensitive member in a predetermined direction;

a light receiving unit configured to receive the light beams deflected by said deflection unit, for receiving each light beam; and a control unit configured to perform light amount control for controlling an amount of light of each of the light beams emitted respectively from said light emitting elements, based on a result of reception of the light beam by said light receiving unit, wherein in said light source, said first light emitting element and said second light emitting element are arranged such that both a light beam from said first light emitting element and a light beam from said second light emitting element enter said light receiving unit at the same time and a light beam from said third light emitting element and the light beam from said first light emitting element do not enter said light receiving unit at the same time, and the light beam from said first light emitting element and the light beam from said second light emitting element are adjacent to each other in the predetermined direction, and wherein said control unit executes the light amount control of the light beam from said first light emitting element and the light amount control of the light beam from said second light emitting element, in receptive different cycles of scanning of the light beams, and executes the light amount control of the light beam from said first light emitting element and the light amount control of the light beam from said third light emitting element, in the same cycle of scanning of the light beams.

4. The image forming apparatus according to claim 3, wherein said light receiving unit includes a first light receiving part configured to receive a light beam from a predetermined one of said plurality of light emitting elements to thereby generate a synchronization signal for controlling timing of emission of the light beam from each of said plurality of light emitting elements, and a second light receiving part disposed downstream of said first light receiving in a direction of scanning the light beams and configured to receive each of said plurality of light beams for enabling said control unit to execute the light amount control for said plurality of light emitting elements, wherein said control unit controls timing of lighting of each of said plurality of light emitting elements, based on the synchronization signal, such that a light beam from one of said plurality of light emitting elements enters said second light receiving part.

* * * * *